United States Patent [19]

Gorza

[11] Patent Number: 5,062,225

[45] Date of Patent: Nov. 5, 1991

[54] SKI BOOT CLOSURE DEVICE HAVING A LEVER WITH A SLIDING TENSIONING ARRANGEMENT

[75] Inventor: Roberto Gorza, Feltre, Italy

[73] Assignee: Nordica S.p.A., Montebelluna, Italy

[21] Appl. No.: 542,547

[22] Filed: Jun. 25, 1990

[30] Foreign Application Priority Data

Jul. 4, 1989 [IT] Italy ..... 59375/89[U]

[51] Int. Cl.[5] ..... A43B 5/04

[52] U.S. Cl. ..... 36/117; 36/50; 36/121; 24/68 SK

[58] Field of Search ..... 36/117, 119, 120, 121, 36/50; 24/68 SK

[56] References Cited

U.S. PATENT DOCUMENTS 4,539,763 9/1985 Walkhoff ..... 36/120
4,682,426 7/1987 DeMarchi ..... 36/50
4,691,454 9/1987 Ottieri ..... 36/117
4,908,965 3/1990 Iwama ..... 36/119
4,918,842 4/1990 Lederer ..... 36/117

FOREIGN PATENT DOCUMENTS 3532455 4/1986 Fed. Rep. of Germany ..... 36/117

*Primary Examiner*—Paul T. Sewell
*Assistant Examiner*—Thomas P. Hilliard
*Attorney, Agent, or Firm*—Guido Modiano; Albert Josif

[57] ABSTRACT

A closure device for ski boots includes a lever and a slider adapted to actuate a cable for closing the quarters; the slider can be moved for lowering or increasing the relative length of the cable for adjusting the closure strength; the cable engages the lever at fixed points so that the slider is not directly subjected to stresses and particularly to an overturning moment.

12 Claims, 1 Drawing Sheet

SKI BOOT CLOSURE DEVICE HAVING A LEVER WITH A SLIDING TENSIONING ARRANGEMENT

BACKGROUND OF THE INVENTION

The present invention relates to a ski boot closure device.

Several devices for ski boots are currently known which allow for example to close the quarters and lock one or more pressers arranged inside the shell.

A U.S. Pat. No. 4,571,855, is known, for example, to disclose a lever for the closure of the quarters which uses two cables and has a system for the differentiated tensioning thereof.

This differentiation is intrinsically necessary, since when the quarters are opened the working length of the cables must be different, and this has made necessary to provide a guide member for said cables above said lever at the rear quarter.

This undoubtedly produces a disadvantage, because too much space is taken up on the rear quarter and, besides the undesirable aesthetic aspect, no other devices can be placed at the rear quarter.

A French patent, No. 84.16966 filed on Oct. 30, 1984, is also known which describes a rear-entry ski boot comprising a lever provided with two coaxial winders for two separate cables.

A first cable closes the quarters and the other cable operates a foot instep presser.

Said two separate cables can be actuated by means of a single knob, and means are provided in said knob adapted to provide different transmission ratios; the different transmission ratios are required both to obtain the different take-up of the cables and to balance the efforts for the tightening thereof.

Said known device, however, is relatively complicated structurally, because it requires a different degree of take-up of the cables for an equal number of turns imparted to the single knob.

Closure and adjustment devices are also known which are constituted by traction elements associated with a vertical lever so that an increase in the tension of said traction elements is followed by a shift of the point of application of the resisting force, and thus the effort on the lever is variable.

Other known devices comprise a vertical lever associated for example with the rear quarter of the boot and sliders axially movable on a threaded stem associated with a lever for the take-up of the cables. When the lever is closed, the slider and stem are subjected to a moment that, after some time, eventually leads to the stripping of the thread of the threaded stem or of the complementary thread of the sliders.

SUMMARY OF THE INVENTION

The aim of the present invention is to eliminate the disadvantages described above in known types by providing a closure device for rapidly and easily adjusting the tightening action of a traction element.

Another important object is to provide a structurally simple device having a small size and which does not substantially alter the aesthetic aspect of the boot.

Another important object is to provide a device in which the moving parts are not subjected to a moment, during the closure, which might compromise their reliability.

Not least object is to provide a reliable device with low manufacturing costs.

The above mentioned aim and objects, as well as others which will become apparent hereinafter, are achieved by a closure device, particularly for ski boots, comprising a lever, which is articulated, at one end, to a ski boot, and at least one slider which interacts with means which can be actuated by the skier for its axial movement with respect to said lever, characterized in that it comprises at least one traction element which is guided both on said lever and, in separate points, to said at least one slider, said traction element exiting at the sides of said lever at fixed openings, said at least one traction element having at least two entry points and two exit points on said at least one slider.

BRIEF DESCRIPTION OF THE DRAWINGS

Further characteristics and advantages of the invention will become apparent from the detailed description of a preferred embodiment, illustrated only by way of non-limitative example in the accompanying drawings, wherein.

DESCRIPTION OF THE PREFERRED EMBODIMENTS

Figure 1:
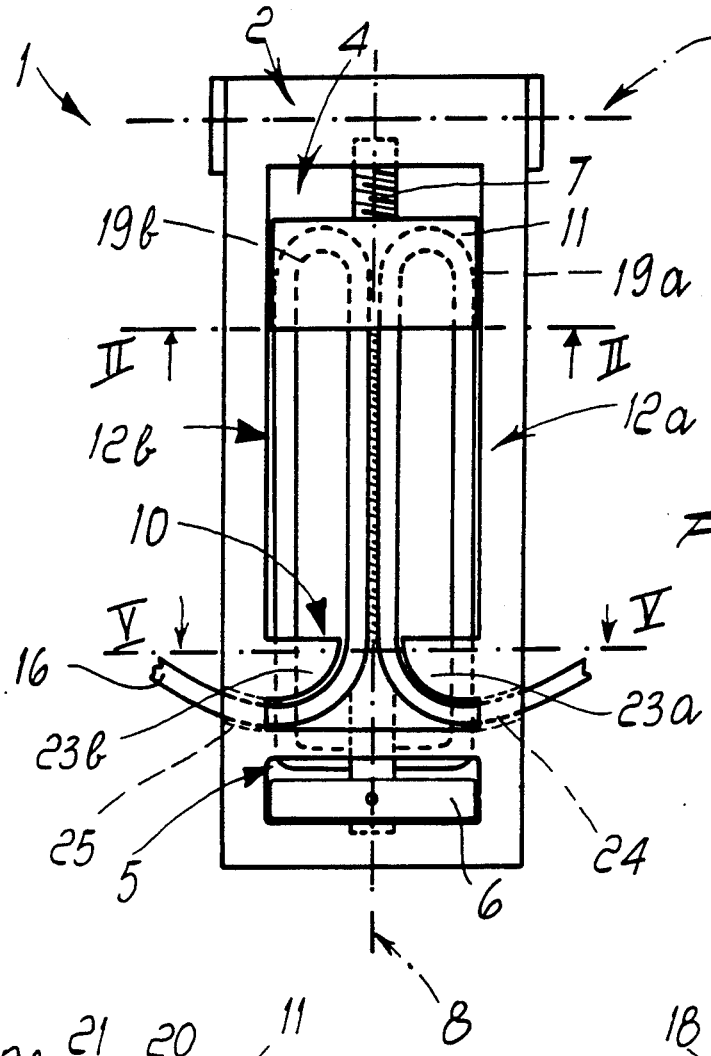
FIG. 1 is a top view of the device.
Figure 2:
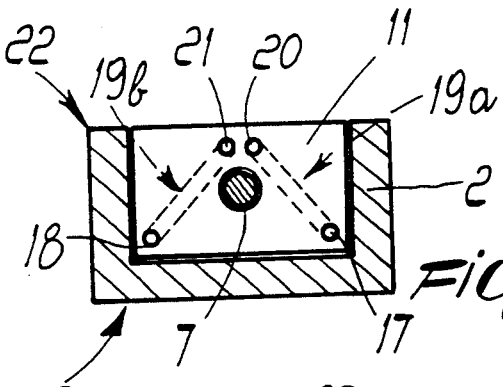
FIG. 2 is a view taken along the sectional plane II—II of FIG. 1.

With reference to the above figures, the device, generally indicated by the reference numeral 1, comprises a lever 2 pivoted, at one end, at a transverse axis 3, to a portion of a ski boot, such as for example the rear quarter.

A first axial seat 4 and a second axial seat 5 are separately provided at the lever 2.

The first axial seat 4 is adjacent to the transverse axis 3 and has a greater longitudinal extension than the second axial seat 5.

A knob 6 is located at said axial seat 5 and is accessible to the skier; said knob is keyed at a rod 7 which is freely pivoted to the transverse ends of the lever 2 and is threaded at the first axial seat 4.

Said rod 7 has a longitudinal axis 8 substantially corresponding to the center line of the lever 2 and passes at an adapted first hole 9 provided on a dividing wall 10 defined between said first axial seat and said second axial seat.

A complimentarily threaded slider 11 is associated at said rod 7 with the first axial seat 4 and its movement is controlled by the rotation of the knob 6.

A second hole 13 and a third hole 14 are provided at the dividing wall 10, proximate to the longitudinal perimetric edges **12*a* and 12*b* of said first and second axial seats; said holes are through holes and are arranged parallel to the longitudinal axis 8 on a plane which is adjacent to the lower surface 15 of the lever 2**.

The ends of a traction element, such as a cable 16, are inserted at said second and third holes and are guided at said slider 11 by appropriate guiding means.

In particular, said slider has, approximately at the same plane of arrangement as said second and third holes, a fourth hole 17 and a fifth hole 18 which are connected, through a U-shaped duct **19*a* and 19*b*, which acts as the traction element guiding means, to a sixth hole 20 and to a seventh hole 21**.

These last are arranged at the same surface of said slider 11 on which said fourth and fifth holes are defined.

Said sixth and seventh holes are furthermore arranged at a plane which is approximately parallel to the plane of arrangement of said fourth and fifth holes but is located proximate to the upper surface 22 of the lever of the slider, and are arranged adjacent to one another and proximate to the longitudinal middle axis of the lever 2.

The ends of the cable 16 are then subsequently guided at guiding means advantageously constituted by adapted curved shoulders 23*a* and 23*b* provided on said dividing wall 10 which are such as to convey the ends of said cable laterally to the lever 2.

In particular, said ends of the cable 16 exit laterally to the lever 2 through a first fixed opening 24 and a second fixed opening 25.

The ends of the cable 16 are then guided at the lateral surfaces of the front quarter.

The device has the exit of the ends of the cable from the lever at the first and second fixed openings and a multiple cable take-up.

Upon the actuation of the knob 6 and therefore upon the movement of the slider 11, for example toward the transverse axis 3 of the lever 2, a tensioning of the cable 16 in fact occurs, taking up a portion thereof which is double with respect to the movement of the slider 11, thus reducing the adjustment stroke and therefore the time needed to select the required degree of tightening.

The longitudinal extension to be provided for the lever 2 is consequently also reduced.

The fact that the exit of the ends of the cable are arranged at fixed openings, regardless of the adjustment of the tension of the cable which can be obtained by means of the movement of the slider 11, furthermore allows to have a constant-length resisting lever arm.

A shift of the point of application of the resisting force does not in fact follow an increase in the tension of the cable, and the lever thus operates with a constant effort.

The arrangement of the fourth and fifth holes and of the sixth and seventh holes is furthermore such as to define a geometrical figure which internally contains the longitudinal axis 8 of the rod 7: in this manner the reactions to the efforts imparted by the cable 16 are balanced at the slider 11, thus limiting the moment thereon.

Figure 3:
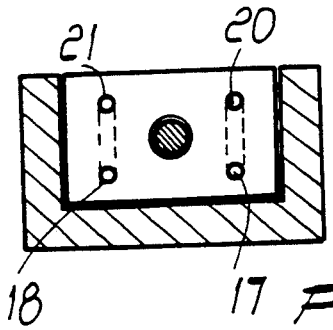
Figure 5:
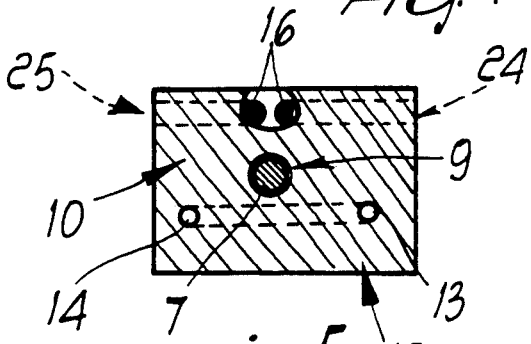
FIG. 5 is a view taken at the sectional plane V—V of FIG. 1.

If the arrangement of said sixth and seventh holes is the one illustrated in FIG. 3, therefore with the fourth and sixth holes as well as the fifth and seventh holes arranged on the same plane, a condition of symmetry is achieved in which the efforts are discharged directly at the rod 7.

Figure 4:
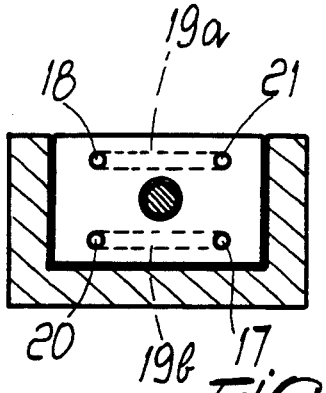
FIGS. 3 and 4 are views, similar to FIG. 2, of two further embodiments of the passage of the cable within the slider.

A similar result is achieved in FIG. 4 if the ducts 19*a* and 19*b* are arranged so as to place the sixth and seventh holes respectively at the plane which is parallel to the plane of the lower surface 15 of the lever 2 which passes through the fourth hole 17 and the fifth hole 18.

It has been seen that the invention has achieved the intended aim and objects, a device having been obtained which allows the skier to rapidly and easily adjust the degree of tightening of the cable and subsequently close for example the quarter.

The ducts 19*a* and 19*b* together with the curved shoulders 23*a* and 23*b* and with the first and second fixed openings, allow to select the required degree of tightening by taking up a portion of cable which is double with respect to the axial movement imparted to the slider 11.

The arrangement of the fourth, fifth, sixth and seventh holes furthermore allows to apply balanced efforts at the slider.

The device, according to the invention, is furthermore structurally simple and easy to be industrially manufactured.

The materials employed as well as the dimensions which constitute the individual components of the device may naturally be the most pertinent according to the specific requirements.

I claim:

1. Closure device, particularly for ski boots, comprising a lever which is articulated, at one end, to a ski boot, and at least one slider which is provided with means which can be actuated by the skier for its axial movement with respect to said lever, said device further comprising at least one traction element which is guided both on said lever and, in separate points, to said at least one slider, said traction element exiting at the sides of said lever at fixed openings, said at least one traction element having at least two entry points and two exit points on said at least one slider, a first axial seat and a second axial seat being provided at said lever, said seats being separated by a dividing wall, said first and second axial seats being connected by means of a first hole arranged according to an axis which is parallel to the longitudinal axis of said lever, wherein second and third through holes are provided at said dividing wall adjacent to the longitudinal perimetric edges of said first and second axial seats, said holes being arranged parallel to the longitudinal axis of said lever on a plane which is adjacent to the lower surface of said lever.

2. Closure device, according to claim 1, wherein said at least two entry and exit points define a geometrical figure which internally contains the axis along which said at least one slider moves.

3. Closure device according to claim 1, wherein said first axial seat is adjacent to a transverse axis of said lever, said transverse axis being an articulation axis of said lever to said ski boot, said first axial seat having a greater longitudinal extension than said second axial seat.

4. Closure device according to claim 1, wherein a knob is located at said second axial seat, said knob being actuated by the skier and being keyed at a rod which is freely pivoted to the ends of said lever and is threaded at said first axial seat, said rod having a longitudinal axis which coincides with said axis of said first hole.

5. Closure device according to claim 4, wherein a complimentarily threaded slider is slidable upon said rod, within said first axial seat, its movement being controlled by the rotation of said knob.

6. Closure device according to claim 1, wherein the ends of a traction element, such as a cable, are inserted at said second and third holes and are guided at fourth and fifth holes provided on said slider at the same plane of arrangement as said second and third holes.

7. Closure device according to claim 6, wherein each of said fourth and fifth holes are connected, through a U-shaped duct, to sixth and seventh holes which are arranged at the same surface of said slider on which said fourth and fifth holes are provided.

8. Closure device according to claim 7, wherein said duct is arranged parallel to said lower surface of said lever.

9. Closure device according to claim 7, wherein said fourth and sixth holes are arranged at the same plane which is parallel to the plane of arrangement of a lower surface of said lever and separate from the parallel plane of arrangement of said fifth and seventh holes.

10. Closure device according to claim 9, wherein said duct is arranged along planes which are parallel to the plane of arrangement of said lower surface of said lever.

11. Closure device according to claim 7, wherein said ends of said cable which exit from said sixth and seventh holes are guided at adapted curved shoulders which are provided on said dividing wall which are such as to convey the end of said cable laterally to said lever.

12. Closure device according to claim 11, wherein said ends of said cable exit, after said curved shoulders, laterally to said lever through adapted first and second fixed openings.

* * * * *